US008292760B2

(12) United States Patent
Johnson

(10) Patent No.: US 8,292,760 B2
(45) Date of Patent: Oct. 23, 2012

(54) SYSTEMS AND METHODS FOR CONTROLLING BASEBALL BAT SWING

(76) Inventor: Kristopher A. Johnson, Seattle, WA (US)

( * ) Notice: Subject to any disclaimer, the term of this patent is extended or adjusted under 35 U.S.C. 154(b) by 0 days.

(21) Appl. No.: 12/839,192

(22) Filed: Jul. 19, 2010

(65) Prior Publication Data

US 2011/0015003 A1 Jan. 20, 2011

Related U.S. Application Data

(60) Provisional application No. 61/226,665, filed on Jul. 17, 2009.

(51) Int. Cl.
*A63B 69/00* (2006.01)

(52) U.S. Cl. ..... 473/450; 473/422; 473/458

(58) Field of Classification Search ..... 473/422, 473/450, 458, 460, 453, 212, 214, 215, 438; D21/685; 482/51, 88; 2/463, 468, 92
See application file for complete search history.

(56) References Cited

U.S. PATENT DOCUMENTS

| | | | | | |
|---|---|---|---|---|---|
| 532,461 | A | * | 1/1895 | Blades | 602/16 |
| 1,643,850 | A | * | 9/1927 | Jones | 602/16 |
| 3,900,199 | A | * | 8/1975 | McGonagle | 473/214 |
| 3,953,034 | A | | 4/1976 | Nelson | |
| 3,975,015 | A | * | 8/1976 | Owens et al. | 473/63 |
| 4,254,953 | A | * | 3/1981 | Marchetti | 473/63 |
| 4,383,685 | A | * | 5/1983 | Bishop | 473/450 |
| 4,688,800 | A | * | 8/1987 | Lopez | 473/215 |
| 4,875,677 | A | * | 10/1989 | Tetreault | 473/458 |
| 4,930,785 | A | | 6/1990 | Mills | |
| 5,135,446 | A | * | 8/1992 | Cooley | 482/51 |
| 5,207,429 | A | | 5/1993 | Walmsley et al. | |
| 5,217,228 | A | | 6/1993 | De Aguilar | |
| 5,222,733 | A | * | 6/1993 | Brunty | 473/438 |
| 5,288,080 | A | | 2/1994 | Tice | |
| 5,390,929 | A | * | 2/1995 | Todaro | 473/215 |
| 5,395,117 | A | * | 3/1995 | Ogden | 473/409 |
| 5,464,222 | A | | 11/1995 | Carney | |
| 5,467,991 | A | | 11/1995 | White, IV et al. | |
| 5,472,204 | A | | 12/1995 | English et al. | |
| 5,494,290 | A | | 2/1996 | Stefanoski | |

(Continued)

FOREIGN PATENT DOCUMENTS

WO WO 2008025091 A1 * 3/2008

OTHER PUBLICATIONS

"The Swing Extender," Swing Extender Golf Training Ad, http://www.swingextender.com/app2/index.cfm, downloaded Jul. 15, 2009 (1 pg,).

(Continued)

*Primary Examiner* — Mitra Aryanpour
(74) *Attorney, Agent, or Firm* — Perkins Coie LLP

(57) ABSTRACT

Systems and methods for controlling a baseball bat swing are disclosed. A system in accordance with a particular embodiment includes an upper arm portion, a lower arm portion pivotably connected to the upper arm portion, and at least one releaseable attachment device carried by the upper arm portion and positioned to releasably attach to the user's arm. The system can further include an adjustment element operatively coupled to the upper arm portion and the lower arm portion, with the adjustment being manipulatable to control an angle between the upper arm portion and the lower arm portion. The system can be employed to train the user to achieve a consistent baseball bat swing.

19 Claims, 9 Drawing Sheets

U.S. PATENT DOCUMENTS

| | | | | |
|---|---|---|---|---|
| D369,391 | S * | 4/1996 | Jump, Jr. | D21/685 |
| 5,544,877 | A * | 8/1996 | Brownell | 473/450 |
| 5,651,743 | A * | 7/1997 | Stephan et al. | 473/450 |
| 5,759,110 | A | 6/1998 | Seibel et al. | |
| 5,769,743 | A * | 6/1998 | Stephan et al. | 473/450 |
| 5,788,582 | A | 8/1998 | Shapiro | |
| 5,865,695 | A * | 2/1999 | Mahala et al. | 473/450 |
| 5,897,441 | A | 4/1999 | Apthorp | |
| 6,059,668 | A | 5/2000 | Marley, Jr. | |
| 6,149,531 | A | 11/2000 | Hooker | |
| 6,149,537 | A | 11/2000 | Hooker | |
| 6,582,318 | B1 * | 6/2003 | Halfacre | 473/215 |
| 6,645,093 | B2 * | 11/2003 | Sheppard | 473/450 |
| 6,758,760 | B1 | 7/2004 | Kellogg et al. | |
| 6,875,135 | B2 * | 4/2005 | Tracy, Sr. | 473/438 |
| 7,374,502 | B2 * | 5/2008 | Comello, Jr. | 473/458 |
| 7,722,472 | B2 * | 5/2010 | Cameron et al. | 473/2 |
| 7,854,668 | B2 * | 12/2010 | Shelton | 473/450 |
| 8,043,173 | B2 * | 10/2011 | Menalagha et al. | 473/464 |
| 2003/0069094 | A1 * | 4/2003 | Sheppard | 473/450 |
| 2003/0148833 | A1 * | 8/2003 | O'Hara | 473/458 |
| 2009/0253527 | A1 * | 10/2009 | Abraham | 473/214 |

OTHER PUBLICATIONS

NK Products, Inc., "Linedrive Laser Trainer and Swing Analyzer," http://www.linedrivelaser.com/baseball_products.php, downloaded Dec. 8, 2011, NK Products, Inc., Garden Grove, CA (4 pgs.).

* cited by examiner

SYSTEMS AND METHODS FOR CONTROLLING BASEBALL BAT SWING

CROSS REFERENCE TO RELATED APPLICATION

The present application claims priority to U.S. Provisional Application No. 61/226,665, filed Jul. 17, 2009 and incorporated herein by reference.

TECHNICAL FIELD

The present disclosure is directed generally to systems and methods for controlling the bat swing of a baseball player.

BACKGROUND

Baseball players, professional and amateur, wish to execute a strong bat swing in a consistent manner. Several aspects of the embodiments disclosed herein can facilitate these aspects of the player's performance.

DETAILED DESCRIPTION

Aspects of the present disclosure are directed to fixed or adjustable, proprioceptive training devices that can facilitate a player's development of a repeatable, accurate and/or quick baseball bat swing.

Figure 1:
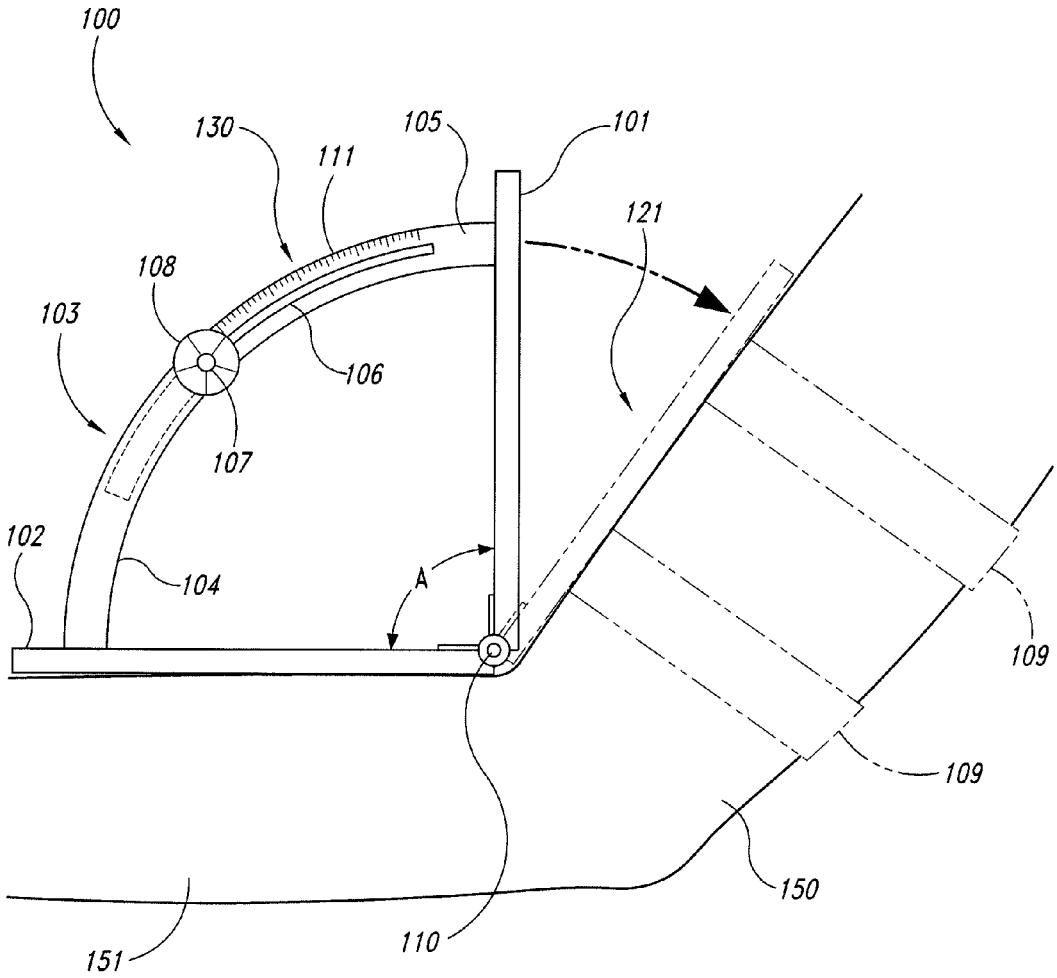
FIG. 1 is a schematic illustration of a device worn by a batter in accordance with an embodiment of the disclosure.

FIG. 1 is a schematic illustration of a device 100 (e.g., an arm-mounted device) configured in accordance with an embodiment of the disclosure. The device 100 is viewed from above and is worn by a user whose arm (in FIG. 1) is bent in a generally horizontal plane. In one aspect of this embodiment, the device 100 includes an upper arm portion 101 that is attached to the user's upper arm 150 with an attachment device 121 which, in a particular embodiment, includes one or more releasable straps 109. The device 100 can further include a lower arm portion 102 that is not attached to the user's forearm 151, but which acts as a proprioceptive surface against which the user can rest the forearm 151 when preparing to take a swing with a baseball bat. Accordingly, during the course of the swing, the user's forearm 151 can open and move away from the lower arm portion 102.

The device 100 can further include an intermediate portion 103 positioned between the upper arm portion 101 and the lower arm portion 102. In a particular embodiment, the intermediate portion 103 can set the included angle A between the upper arm portion 101 and the lower arm portion 102. In an embodiment shown in FIG. 1, the intermediate portion 103 can be adjustable, allowing the user to selectively adjust the included angle A to a desired value. Accordingly, the intermediate portion 103 can include an adjustment element 130 that the user can manipulate to select a desired included angle A. In one embodiment, the adjustment element 130 includes a first element 104 attached to the lower arm portion 102, and a second element 105 attached to the upper arm portion 101. The first and second elements 104, 105 can be movable relative to each other about a pivot axis or hinge 110, allowing the user to change the included angle A. In a particular embodiment, the first element 104 can include a post 107 that slides in a circumferential slot 106 carried by the second element 105. The adjustment element 130 can further include a locking knob 108 that allows the user to lock the motion of the first element 104 relative to the second element 105 at a selected angle. The adjustment element 130 can include a scale 111 that identifies angular values. In this manner, the user can try several different values of the included angle A, track batting performance at each angle, and when a desirable or optimal angle is obtained, consistently configure the device 100 at that angle. In one embodiment, the device 100 can accommodate included angles A having a value of from about 70° to about 150°. In a further particular embodiment, included angle A can be varied over a range of from about 90° to about 135°, and in a further particular embodiment, the range for the included angle A can be from about 90° to about 110°. In still further embodiments described later, the device 100 can have a fixed included angle A, set at a particular value in the foregoing ranges.

In a representative method of use, a right-handed batter attaches the device 100 to the left bicep or upper arm 150. Left-handed batters attach the device 100 to the right arm. The batter chooses a desired included angle A, e.g., in the range of about 90°-135°. The batter moves to a load position, maintaining contact between the forearm 151 and the lower arm portion 102 of the device 100. The load in a baseball swing is the movement (generally away from the pitcher) which puts the batter into the correct or ideal launch position, e.g., the point from which to start the forward swing. The load involves a stretching or tensing of muscles, preparing them to move the bat forward quickly. The device 100 can train the batter to develop a reproducible load so that they swing from the same point for each swing. In many cases, a reproducible load position is important in order to deliver the bat to the hitting zone in a direct line (as opposed to, e.g., dropping the bat and delivering a "roundhouse" or "drag" swing). In addition, the timing with which the batter delivers the bat improves when the batter starts from the same point on successive swings.

When the forearm 151 is in contact with the lower arm portion 102, the backward movement of the forearm 151 stops because of light tension in the left tricep. The left elbow is kept in close proximity to the torso. This can improve the batter's ability to obtain the correct bat angle. As seen from the pitcher's view of the batter, the correct bat angle is generally obtained when the plane containing the barrel of bat passes through the batter's ear.

The device 100 can help create an improved or optimal "slot" in which to start the swing in a manner that keeps the batter's hands inside the baseball. In addition, embodiments of the device 100 can make this move simple to teach, as all the batter has to do is to move his or her left elbow back toward the pitcher.

The ability to stop the load in the desired (e.g., optimal) position, as well as start the swing in the slot or with an inside move is often very difficult to teach. Embodiments of the device 100 can develop this move in a matter of minutes. This can greatly improve the performance of batters who otherwise never develop this move and for whom the game becomes too fast and difficult.

Bat swing timing is typically very important, as the bat needs to be delivered to the hitting zone at the precise time that the ball is in the zone. A common mistake is that the unaided batter sets the angle between the upper arm and the forearm to be too obtuse. The batter then develops a swing in which the bat is dragged in an indirect path through the hitting zone. This results in a slow, less efficient swing. Embodiments of the device 100 can improve the batter's swing. For example, most baseball players start their swing with a move of their arms and hands generally away from the pitcher into their "load" position. This move produces a tensing or stretching of the muscles which start the swing via the left bicep/core muscles, legs, etc. With the aid of the device 100, the player can be trained to consistently place his or her body in the same position and at the same launch point for each swing, a feature that embodiments of the present disclosure can facilitate.

From this position the player can move the bat in a direct line to the hitting zone. The device 100 can accordingly create a reproducible point in space from which to start the swing. The correct launch point is often difficult to develop and reproduce, particularly in the young player, but also in accomplished players. Embodiments of the device 100 described above can train the player to consistently start the swing at the same launch point. Other embodiments that can obtain the same and/or further benefits are described below.

Figure 2A:
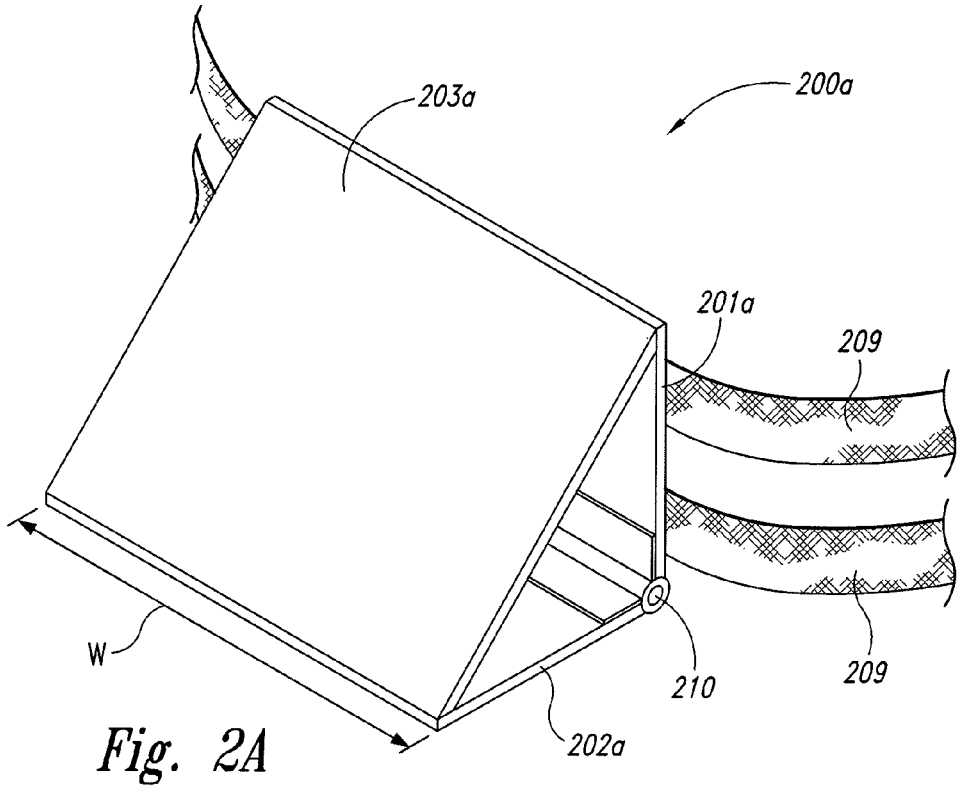
FIGS. 2A and 2B illustrate further embodiments of devices having different widths in accordance with additional embodiments of the disclosure.
Figure 2B:
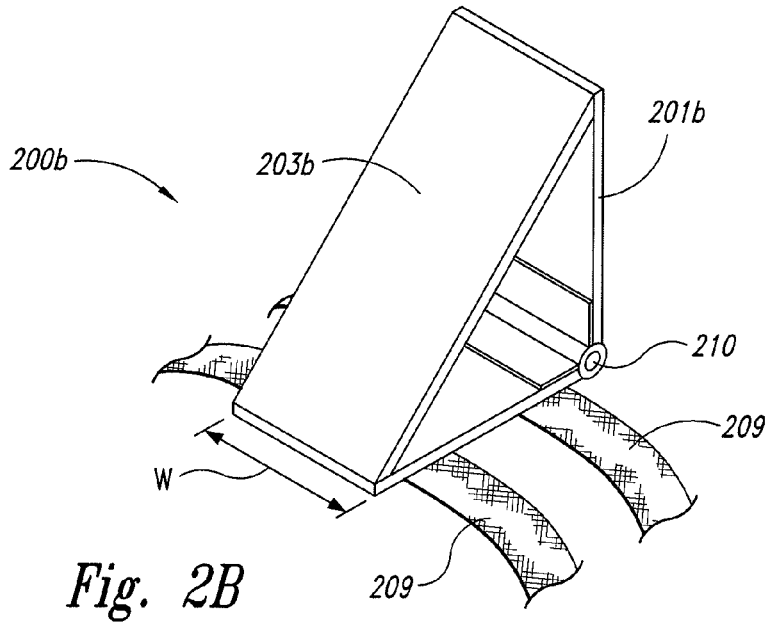

FIG. 2A is a schematic, isometric illustration of a device 200*a* configured in accordance with another embodiment of the disclosure. The device 200*a* can include an upper arm portion 201*a* attached to the batter's arm with straps 209 or another attachment device, a lower arm portion 202*a*, and an intermediate portion 203*a*. In an embodiment shown in FIG. 2A, the portions 201*a*, 202*a*, 203*a* can be fixed relative to each other. In another embodiment, the device 200*a* can include a hinge 210 that allows the upper arm portion 201*a* to move relative to the lower arm portion 202*a*. Accordingly, in such an embodiment, the intermediate portion 203*a* can have features (e.g., similar to those described above with reference to FIG. 1) that facilitate movement of the upper arm portion 201 and the lower arm portion 202*a* relative to each other. In one aspect of an embodiment shown in FIG. 2A, the overall width W of the device 200*a* can be relatively broad, to provide a significant amount of surface contact between the device 200*a* and the batter's arms. In another embodiment shown in FIG. 2B, a device 200*b* can include narrower upper arm portion 201*b*, a narrower lower arm portion 202*b*, and a narrower intermediate portion 203*b*. Accordingly, the overall width W of the device 200*b* shown in FIG. 2B can be relatively small. The particular width of a device selected by a batter can depend upon the batter's size and physiology. For example, in some cases, female batters may prefer the narrower device 200*b* shown in FIG. 2B to avoid contact between the device and the batter's breast. This feature may also be associated with embodiments described later with reference to FIGS. 4 and 5.

Figure 3:
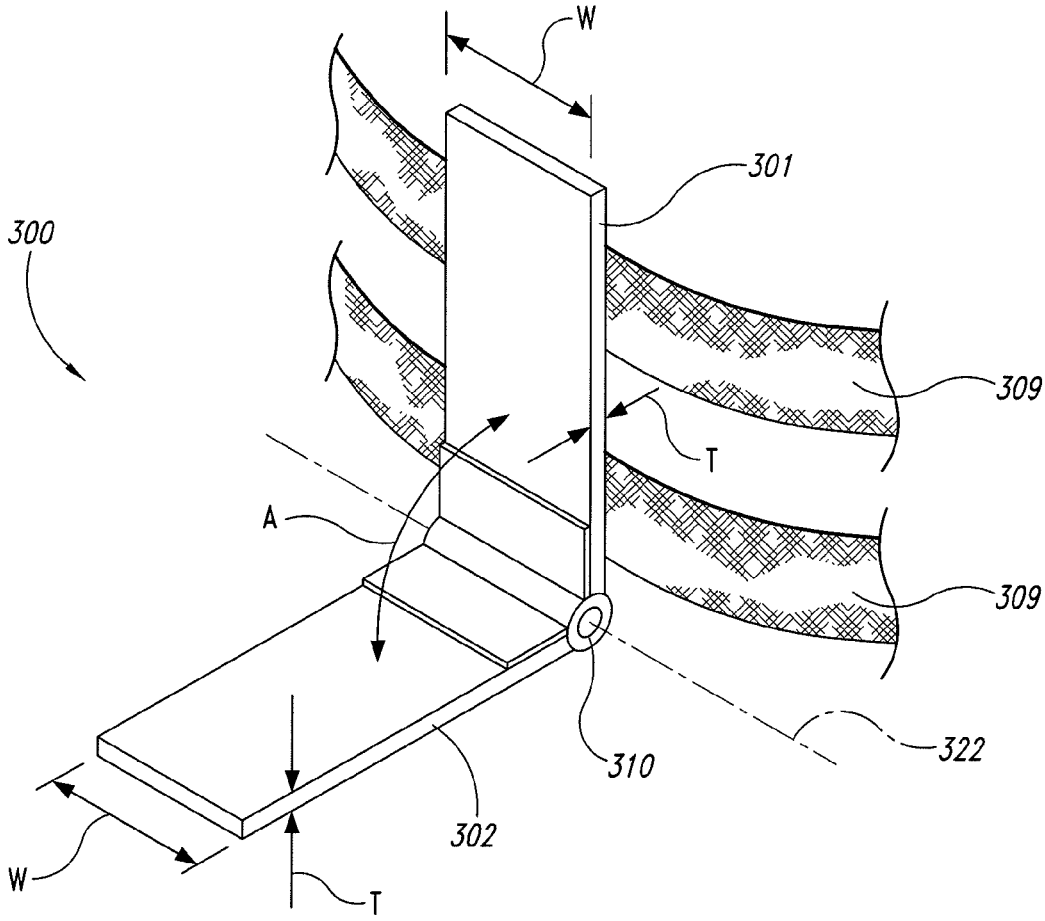
FIG. 3 is a partially schematic, isometric illustration of a device configured in accordance with still a further embodiment of the disclosure.

FIG. 3 is a partially schematic, isometric illustration of a device 300 that has an upper arm portion 301 with straps 309, a lower arm portion 302, and no intermediate portion. Instead, the device 300 can include a hinge 310 that has a sufficient internal resistance to remain in a selected position, once the batter selects a desired included angle A. In a particular embodiment, the hinge 310 can include an arrangement of detents that allow the batter to move the upper arm portion 301 and the lower arm portion 302 relative to each other, but that also restrict accidental movement once the batter has selected a desired position. In a particular embodiment, the detents can be closely spaced and can allow the batter to select the included angle A in increments of about 2°. In other embodiments, this increment can have other values. In any of these embodiments, the resistance provided by the hinge 310 is great enough to prevent the batter from inadvertently changing the included angle A when positioning his or her arms in the load position. At the same time, the hinge 310 can allow the user to deliberately change the included angle when desired.

As shown in FIG. 3, the upper arm portion 301 and the lower arm portion 302 can each have a thickness or thickness extent T and a width or lateral extent W that is larger than the thickness extent T. The hinge 310 can allow the upper and lower arm portions 301, 302 to pivot relative to each other about a pivot axis 322 that is generally parallel with the lateral extent or width W of the upper arm portion 301 and/or the lower arm portion 302. In other embodiments, the pivot axis can have the opposite orientation, as will be described further with reference to FIG. 4.

In several of the embodiments described above, the device is placed in the crook of the batter's arm, directly opposite the elbow. In other embodiments, the device can be placed on top of the batter's arm and/or below the batter's arm. For example, in an embodiment shown in FIG. 4, a device 400 can include an upper arm portion 401 that is attached to the upper surface of the batter's upper arm 150 with straps 409. The device 400 can further include a lower arm portion 402 that rests on the upper surface of the batter's forearm 151. The batter can selectively adjust the included angle A using a hinge 410 that operates in a manner generally similar to that described above with reference to FIG. 3. The lower arm portion 402 can include a stop 412 against which the batter presses the forearm 151 when in the load position. As the batter swings, the forearm 151 can swing outwardly away from the stop 412.

Figure 4:
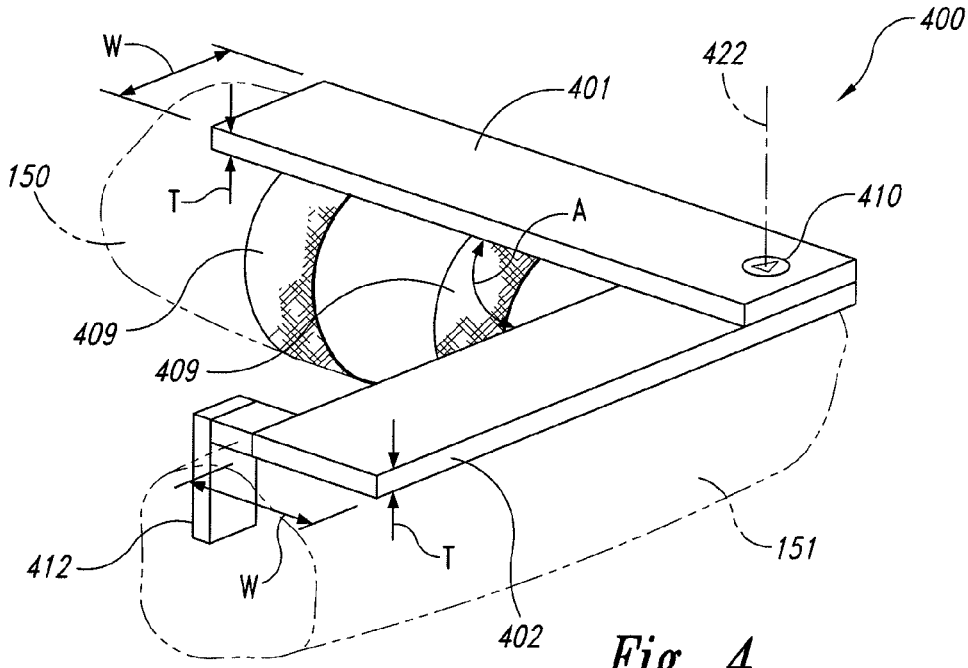
FIG. 4 is a partially schematic, isometric illustration of a device having a stop engaged by the batter's arm in accordance with an embodiment of the disclosure.

As shown in FIG. 4, the upper arm portion 401 and the lower arm portion 402 can each have a lateral extent or width W that is greater than a corresponding thickness extent T. The hinge 410 can allow the upper arm portion 401 and the lower arm portion 402 to pivot relative to each other about a pivot axis 422 that is generally parallel to the thickness extent T, rather than the lateral extent W. This arrangement differs from the arrangement described above with reference to FIG. 3 and results from the placement of the device on top of the batter's arm or below the batter's arm, rather than in the crook of the batter's arm.

Figure 5:
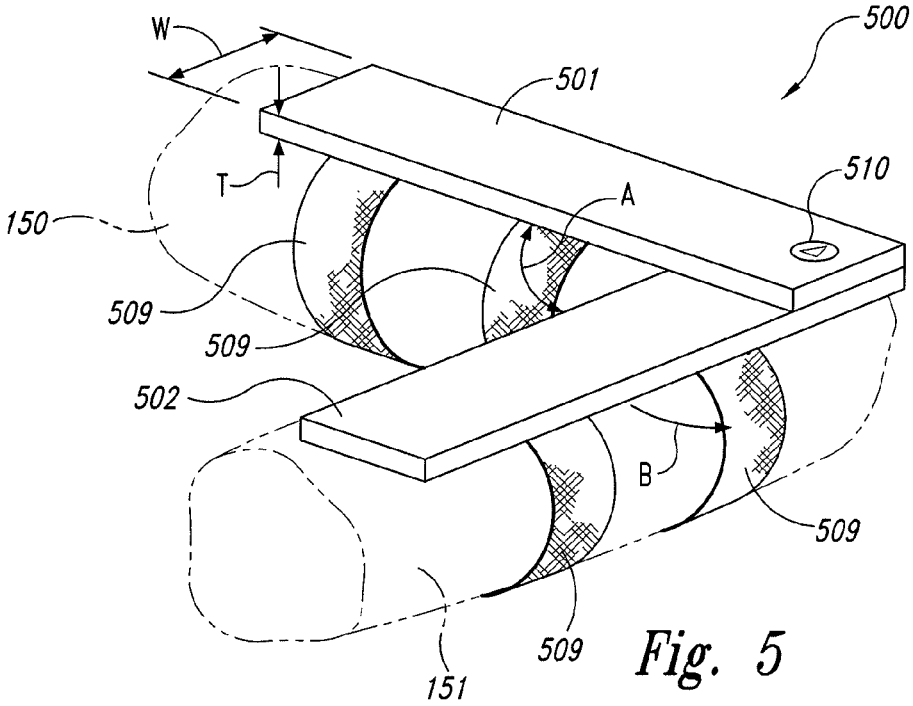
FIG. 5 is a partially schematic, isometric illustration of a device that may be attached to a batter's forearm and upper arm in accordance with another embodiment of the disclosure.

FIG. 5 is a partially schematic, isometric illustration of a device 500 having an upper arm portion 501 that is releasably attached to the batter's upper arm 150 with straps 509, and a lower arm portion 502 that is releasably attached to the batter's forearm 151 with additional straps 509. The device 500 can further include a hinge 510 that allows the user to selectively adjust the included angle A. In addition, the hinge 510 can include an adjustable internal stop that prevents the included angle A from being less than a selected value (e.g., a value in the range of from about 70° to about 150°). However, the hinge 510 can allow the lower arm portion 502 to move freely relative to the upper arm portion 501 in the opposite, outward direction, as indicated by arrow B. Accordingly, the batter can select a desired included angle A, move the forearm 151 toward the upper arm 150 until the hinge 510 prevents further inward movement, and then freely move the forearm 151 as the batter swings the bat.

In any of the foregoing embodiments, the components of the device can be selected to provide sufficient rigidity, while still facilitating for the batter's comfort. For example, the device can be made from suitable plastics, metals, woods, and/or other materials. These materials can be selected to be strong enough so as not to be crushed during normal use. In particular embodiments, portions of the device (e.g., the upper arm portion and/or the lower arm portion) can include padding to provide for the batter's comfort. The padding can be compliant enough to feel comfortable against the batter's skin, but not so compliant as to interfere with the batter's ability to consistently place his or her arm at the proper included angle A.

Figure 6:
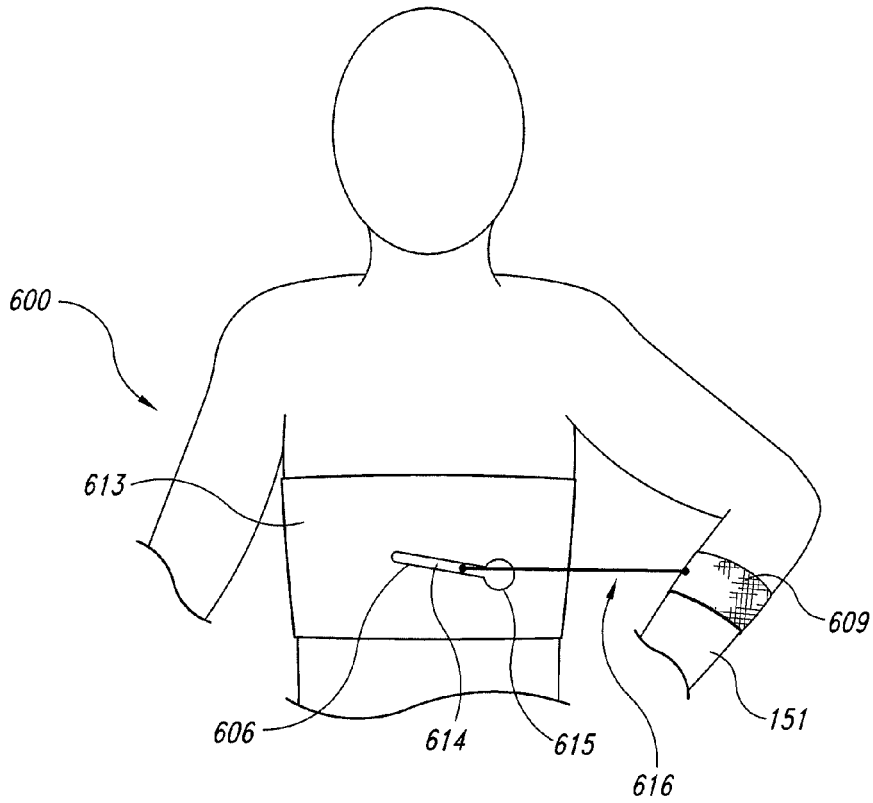
FIG. 6 is a schematic illustration of a device configured to restrain a batter's arm motion relative to the batter's body in accordance with another embodiment of the disclosure.

Devices in accordance with other embodiments of the present disclosure can control other aspects of the batter's swing, in addition to or in lieu of the aspects described above. For example, a device 600 shown in FIG. 6 can be configured to train the batter to have a "tight" or "closed" swing, in which the batter's elbow remains close to the batter's torso through much of the swing. In a particular aspect of this embodiment, the device 600 can include a belt 613 worn around the batter's torso, a strap 609 worn on the batter's forearm 151, and a motion restrictor 616 connected between the strap 609 and the belt 613. In a particular embodiment, the belt 613 can include a slot 606 that receives a portion of the motion restrictor 616 to both guide and constrain the motion of the batter's arm relative to the batter's torso. In a particular embodiment, the slot 606 can include a constraining portion 614 that restricts the motion of the batter's arm during an initial part of the swing, and a release portion 615 that allows the batter's arm to move further away from the torso toward the end of the swing.

Figure 7:
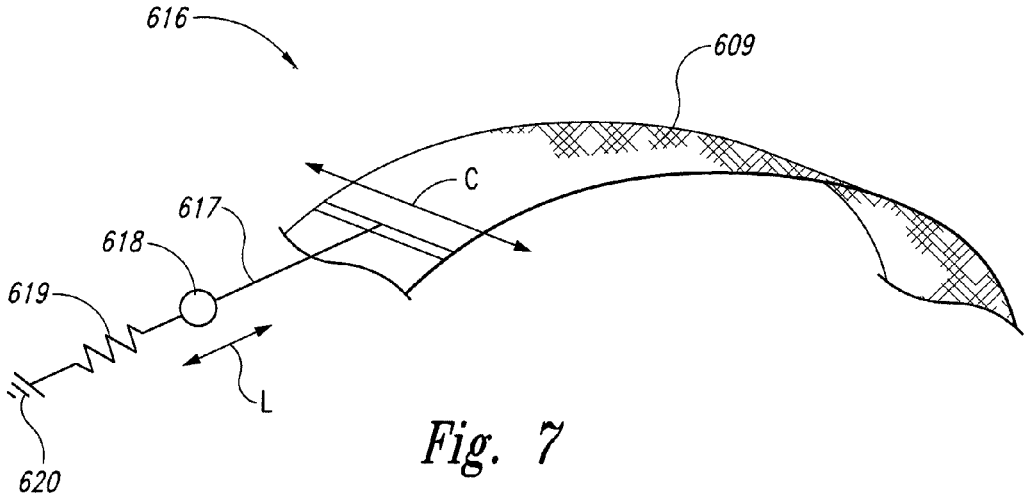
FIG. 7 is a schematic illustration illustrating further aspects of an embodiment of the device shown in FIG. 6.

In a particular example shown in FIG. 7, the motion restrictor 616 can include an inelastic portion (e.g., an inelastic line 617) and an elastic portion (e.g., an elastic line 619). A ball 618 or other captured device is located between the inelastic line 617 and the elastic line 619. The position of the ball 618 can be adjusted along the inelastic line 617, as indicated by arrow L. The inelastic line 617 can be attached to the strap 609, also in an adjustable manner, as indicated by arrow L. The opposite end of the motion restrictor 616 includes an attachment device 620 that is attached to the interior of the slot 606 shown in FIG. 6.

During use, the batter stows the elastic line 619 in the slot 606, and slides the ball 618 into the slot 606 at the release portion 615. When the batter assumes the load position, the ball 618 travels upwardly and to the left in the slot 606. As the batter swings, the ball 618 rides in the slot 606, and the inelastic line 617 keeps the batter from moving his or her elbow by more than a preset distance away from the torso. In a particular embodiment, the present distance (established by the position of the ball 618 along the line 617) can be about four inches, but this value can be adjusted depending on the size and/or other characteristics of the batter. As the batter completes the swing, the ball 618 reaches the release portion 615 of the slot 606, and exits the slot 606, allowing the batter to open up and move his or her arm away from the torso. At the same time, the presence of the elastic line 619 attached to the interior of the slot 606 can prevent the ball 618 from swinging about in an uncontrolled manner and interfering with the batter. In a particular embodiment, the ball 618 and the slot 606 can be constructed from metal or metalized components to reduce sliding friction as these components move relative to each other. In other embodiments, these components can be manufactured from other materials.

Figure 8:
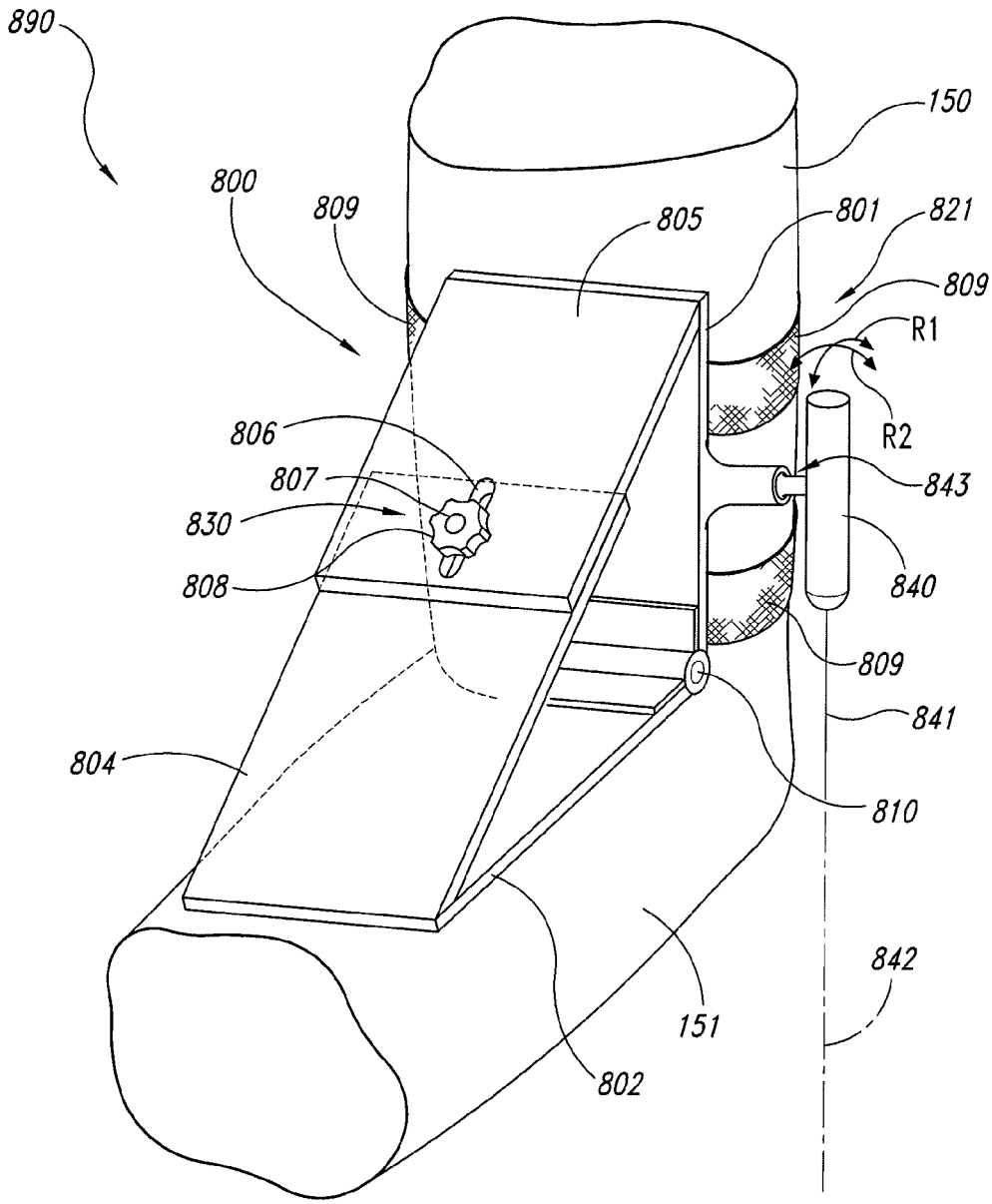
FIG. 8 is a partially schematic, isometric illustration of a system that includes an arm-mounted device and a light source configured in accordance with an embodiment of the disclosure.

FIGS. 8-11 illustrate systems in accordance with several embodiments of the disclosure that include both in arm-mounted device to control the player's load position, and a tracking device to track the player's swing. FIG. 8 is a partially schematic, isometric illustration of a system 890 that includes an arm-mounted device 800 and a light source 840. The arm-mounted device 800 can include features generally similar to those of any of the foregoing embodiments described above with reference to FIGS. 1-5. In a particular embodiment, the arm-mounted device 800 includes an upper arm portion 801 attached to the user's upper arm 150 with an attachment device 821. In a particular embodiment, the attachment device 821 includes multiple straps 809. In other embodiments, the attachment device 821 can include other arrangements. The upper arm portion 801 can be pivotably connected to a lower arm portion 802 at a hinge 810. The arm-mounted device 800 can further include an adjustment element 830 operatively coupled to the upper arm portion 801 and the lower arm portion 802 to allow the user to change or adjust the included angle A between the upper arm portion 801 and the lower arm portion 802. In a particular embodiment, the adjustment element 830 can include a post 807 depending from a first element 804 and received in a slot 806 positioned in a overlapping second element 805. The adjustment element 830 can further include a knob 808 that is threadably or otherwise engaged with the post 807 to secure the first and second elements 804, 805 relative to each other in a selected position corresponding to a desired included angle A.

The system 890 can further include a light source 840 that is carried by the arm-mounted device 800. In a particular embodiment, the light source 840 can include a laser or other focused light source that emits a light beam 841 along a light emission axis 842. The light source 840 can be attached to the arm-mounted device 800 at a joint 843. In one embodiment, the joint 843 can be fixed and in another embodiment, the joint 843 can be adjustable. For example, the joint 843 can include a ball and socket arrangement that allows the light source 840 to be pivoted about two perpendicular axes (as indicated by arrows R1 and R2) relative to the arm-mounted device 800, thus allowing the user to select a particular orientation of the light emission axis 842 relative to the arm-mounted device. The light source 840 can be positioned at the outside of the user's arm, as shown in FIG. 8, or at other locations (e.g., the inside of the user's arm) in other embodiments. The light source 840 can include a battery or other suitable power supply.

Figure 9:
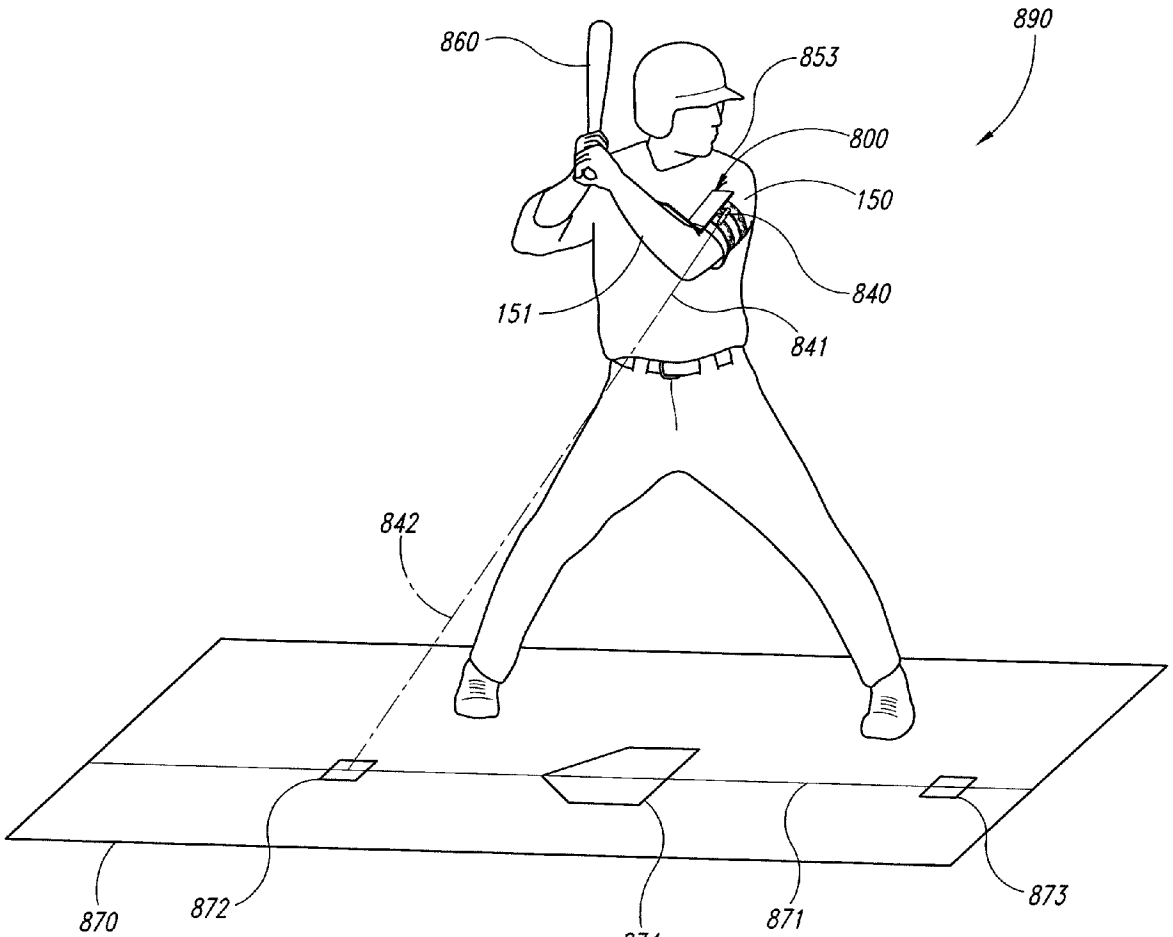
FIG. 9 is a schematic, isometric illustration of a portion of the system shown in FIG. 8, further illustrating a pad configured in accordance with an embodiment of the disclosure.

FIG. 9 illustrates a further embodiment of the system 890 in which a user 853 holding a bat 860 stands on or adjacent to a pad 870 while using the arm-mounted device 800 and the light source 840. The pad 870 can include a home plate indicator 874, and a swing line indicator 871 extending away from the home plate indicator 874 (e.g., toward a virtual pitcher's mound). The pad 870 can further include a load indicator 872 that corresponds to the position of the user's arms when in the load position, and a throw indicator 873 that corresponds to the position of the user's arms when the user has completed the swing and has begun to release the bat 860. In a particular embodiment, the pad 870 can be very simple and can include an unrolled sheet of paper upon which the user 853 or an assistant marks the home plate indicator 874, the load indicator 872, the throw indicator 873, and the swing line indicator 871. In another embodiment, the pad 870 can have a more sophisticated arrangement and can include a mat that may be repeatedly rolled and unrolled between a stowed configuration and a deployed configuration. For example, the pad 870 can include a pliable plastic material that can be rolled and unrolled over and over again. In other embodiments, the pad 870 can include other materials. If any of these embodiments, the pad 870 can include a permanent home plate indicator 874 and swing line indicator 871. The pad 870 can further include a load indicator 872 and a throw indicator 873 that (in at least some embodiments) are adjustable to facilitate use with players of different sizes, as will be discussed in greater detail below with reference to FIG. 10A.

In use, the player or other user 853 can position the arms in the load position, with the user's upper arm 150 and lower or forearm 151 both contacting the arm-mounted device 800 in the manner described above with reference to FIG. 1. The user 853 or an assistant can adjust the orientation of the light source 840 and/or the load indicator 872 so that the light emission axis 842 intersects the load indicator 872 when the user's arms are in the load position. The location of the throw indicator 873 can also be adjusted to coincide with the light emission axis 842 at the desired point. The user 853 then swings the bat 860 from the load position to the throw position. The user 853 or an assistant can simultaneously watch the impingement of the light beam 841 as it tracks along the pad 870 and observe any deviations from the swing line indicator 871. The user 853 can then adjust the swing so that the path of the light beam 841 aligns with (e.g., overlays) the swing line indicator 871. In a particular embodiment, the user 853 can conduct this exercise slowly at first to obtain the proper alignment, and then more quickly to emulate an actual bat swing. The user 853 can repeat this motion over and over again until it becomes more natural (e.g., second nature). For example, the user 853 can swing the bat 860 in this manner for a minimum of 20 times in a row, without adjusting either the arm-mounted device 800 or the light source 840, once the proper orientation of these devices has been selected. In another embodiment, the user 853 can swing the bat 860 up to or over 100 times in a row during a given session without adjusting the arm-mounted device 800 or the light source 840 to facilitate the proper swing becoming second nature (e.g., to facilitate developing the proper muscle memory).

Figure 10A:
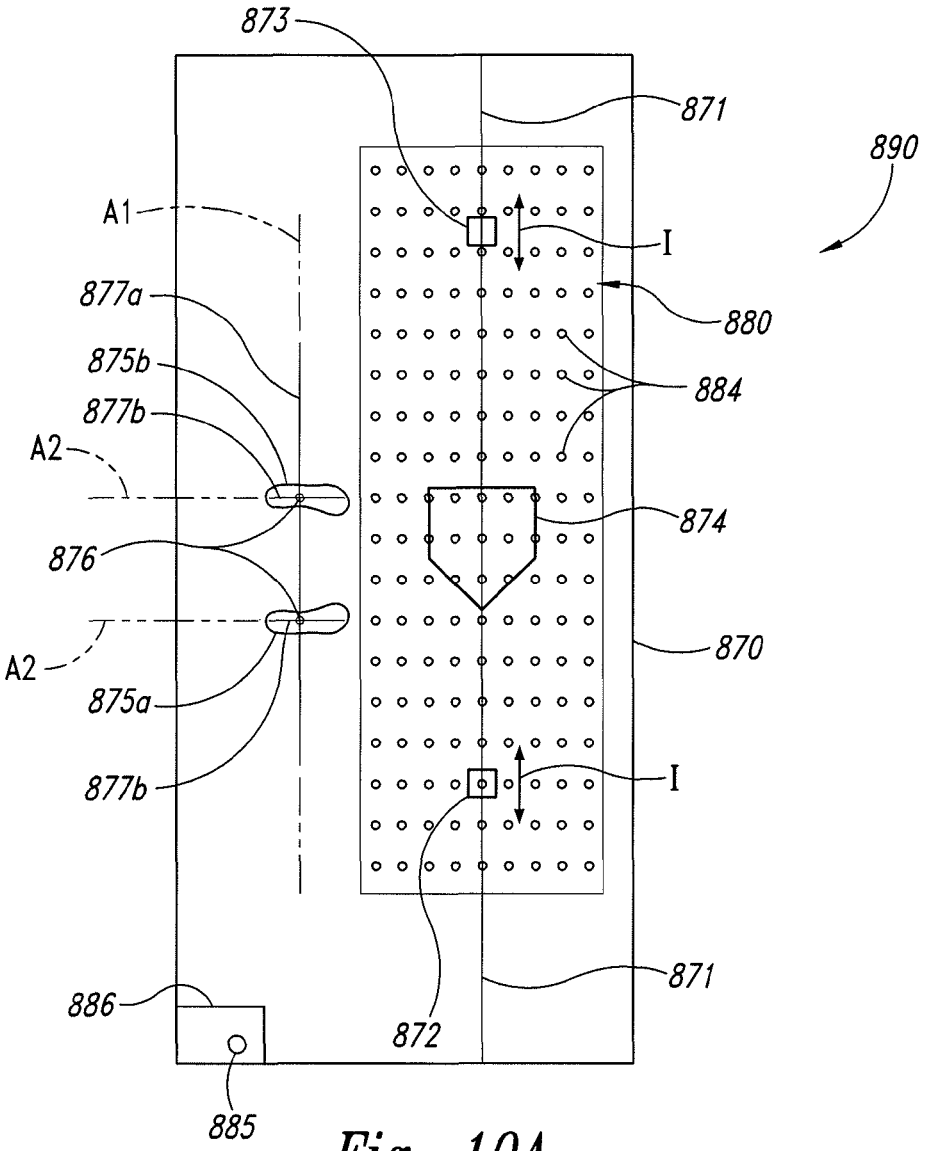
FIG. 10A is a partially schematic, isometric illustration of an embodiment of the pad shown in FIG. 9.
Figure 10B:
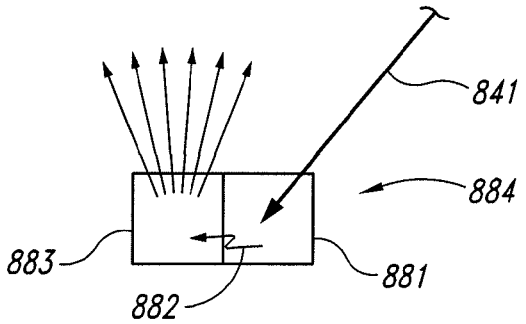
FIG. 10B is a partially schematic illustration of an array element suitable for use with an embodiment of the pad shown in FIG. 10A.

FIG. 10A is partially schematic, plan view of the pad 870, illustrating further features associated with particular embodiments of the overall system 890. For example, in one embodiment, the swing line indicator 871 can include a slot, and the load indicator 872 and throw indicator 873 can each be movable along the slot relative to the home plate indicator 874, as indicated by arrows I. The pad 870 can also include two foot location indicators 875, illustrated as a first foot location indicator 875*a* and a second foot location indicator 875*b*. The foot location indicators 875 can be adjusted to accommodate players of different statures. For example, each of the foot location indicators 875 can include a pin 876 that is movable in an axial adjustment slot 877*a* along a longitudinal axis A1. Each of the foot location indicators 875 can further include a lateral adjustment slot 877*b* that allows the foot location indicators 875 to move laterally back and forth along a corresponding lateral axis A2. In other embodiments, the foot location indicators 875 can be adjustable in other manners. In still further embodiments, the system 890 can include an additional foot location indication indicator 875, e.g., a foot location indicator forward of the two shown in FIG. 10A to aid the player in placing the forward foot during the stride portion of a swing. In any of these embodiments, the user can position the foot location indicators 875 relative to the home plate indicator 874 prior to engaging in a bat swing exercise.

In a particular embodiment, it may be desirable to obtain a semi-permanent or permanent record of the user's swing. For example, the user may wish to use the system 890 without looking downwardly at the pad 870 to track the path of the light beam 841 (FIG. 9) on the pad 870. In another embodiment, the user's swing may be so quick that it is difficult to compare the path of the light beam 841 to the swing line indicator 871. Accordingly, in a particular embodiment, the pad 870 can include a detector/indicator array 880 or other device that detects the passage of the light beam 841 during the user's bat swing, and indicates the passage of the light beam 841 in a semi-permanent or permanent manner that allows the user to review the path of the swing after the swing has been completed. In a particular embodiment, the detector/indicator array 880 can include an array of array elements 884 that are coupled to a power source 886 (e.g., a battery or wall power) to provide a detection and indication function. A particular array element 884 is shown schematically in FIG. 10B, and can include a light detector 881 and a light indicator 883. In a particular embodiment, the light detector 881 and the light indicator 883 are discrete elements that are coupled to each other, and in another embodiment, the light detector 881 and the light indicator 883 form part of a unitary device. In either embodiment, the light detector 881 receives the incoming light beam 841, and in response to receiving the light beam 841, switches from an off state to an on state. For example, the light detector 881 can include a suitable photo detector diode, or other suitable device. In response to achieving the on state, the light detector 881 can transmit a signal along a signal path 882 to the light indicator 883. In response, the light indicator 883 can change from a first state to a second state and in the second state, can present an indication to the user. In a particular embodiment, the indication can include a visual indication. For example, the light indicator 883 can include an LED that illuminates when activated by the corresponding light detector 881. In other embodiments, the light indicator 883 can include other devices. In any of the these embodiments, the detector/indicator array 880 can provide more than an ephemeral indication of the path of the user's swing, and the user can observe this track after completing the swing and adjust his or her swing accordingly. Once the user has completed the swing and observed the corresponding indication the user can activate a reset device 885 (FIG. 10A) to reset the light indicators 883 before taking another swing.

Figure 11:
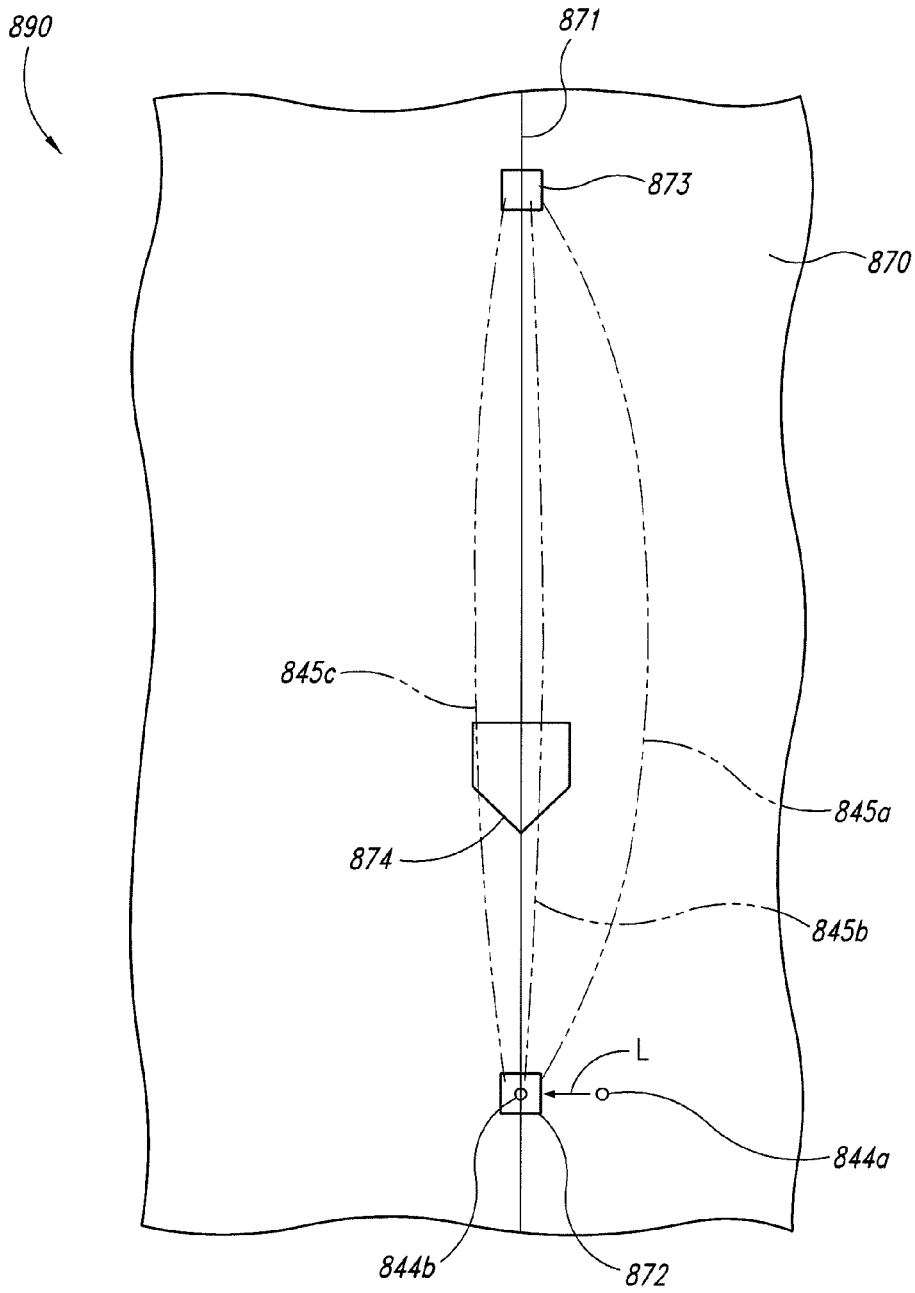
FIG. 11 illustrates representative light paths that maybe indicated during use of a pad in accordance with an embodiment of the disclosure.

FIG. 11 is a partially schematic, plan view illustrating a portion of the pad 870 along with representative light paths 845 (shown as a first light path 845*a*, a second light path 845*b*, and a third light path 845*c*). For purposes of simplicity, certain details of the pad 870 shown in FIG. 10A (e.g., the array 880) are not shown in FIG. 11. When the user activates the system 890 and steps to the home plate indicator 874 with the light source 840 (FIG. 9) activated, the light source 840 can form a first light impingement point 844*a* on the pad 870. The user can adjust the orientation of the light source 840 to align the light impingement point with the load indicator 872, as indicated by arrow L and a second light impingement point 844*b*. The user can then swing the bat, as described above with reference to FIG. 9. In a particular embodiment, the swing produces a first light path 845*a* that does not track the swing line indicator 871. Accordingly, the user can adjust his or her swing until the light path follows the swing line indicator 871, as indicated by the second light path 845*b*. The user can then execute multiple swings, resetting the device between each swing, at least until the user can consistently follow the swing line indicator 871.

In other embodiments, the user may use the system 890 to improve or perfect swings that may not necessarily follow the swing line indicator 871. For example, if the user wishes to specifically train on inside pitches, the user can deliberately produce the third light path 845*c* corresponding to a swing line that will connect with an inside pitch. The user can employ a similar technique to perfect swings for outside pitches or other types of pitches. In still further embodiments, the user can position the light source 840 to form a light path that does not lie directly on the swing line indicator 871. For example, the user can position the light source 840 so that the light path lies parallel to the swing line indicator 871 rather than overlying the swing line indicator 871. In still further embodiments, the user's optimum swing (or other desired swing) may not be along or parallel to the swing line indicator 871. In such instances, the user may establish his or her own swing line indicator to suit the idiosyncrasies of the user's swing. The user can also use embodiments of the system 890 to document and save a particular (e.g., a particularly effective) swing. For example, if a batter has just completed a number of successful at-bats, and is "in the groove," he or she can use the same swing while tracking the swing with the system 890 to light up the associated light path. The system 890 can include a memory that permanently records the light track, and the user can later call up the light track on demand. The user can then match the desired swing by taking a few practice swings with the desired light track illuminated or otherwise indicated, while the system displays a new light track with each swing so the player can tailor his/her swing to the selected swing. In a particular embodiment, the player can follow this routine before every at-bat until the desired swing comes naturally.

One feature of several of the devices configured in accordance with embodiments described above is that they can train the batter to position the forearm more tightly or closely relative to the upper arm, and thus counteract tendency for some batters to open the forearm relative to the upper arm. This is unlike some existing devices and associated methods used in other sports (e.g., golf) which are constructed and used in a manner that prevents, rather than encourages, closure of the forearm relative to the upper arm. As discussed above, training with devices in accordance with the present disclosure can improve the consistency and speed of the batter's swing. In particular, a less obtuse angle between the batter's forearm and upper arm allows the batter to deliver the bat to the hitting zone faster. In addition, devices in accordance with further embodiments of the disclosure (e.g., as shown in FIGS. 6-11) can monitor and/or control the motion of the batter's arm relative to the batter's torso, again to improve the batter's swing. In any of these embodiments, the device is typically used for training, and is then removed for normal play.

Another feature of several of the devices configured in accordance with embodiments described above is that they can aid the user in developing a consistent swing from the load position to the throw position, by providing feedback, e.g. direct feedback, to the user. Accordingly, the user can see the track of a swing in real time, compare the track to a desired track, and make appropriate adjustments. The user can then practice the swing over and over again, without the need for a batting cage.

From the foregoing, it will be appreciated that specific embodiments of the disclosure have been described herein for purposes of illustration, but that various modifications may be made without deviating from the disclosure. For example, the hinges and other components can have other configurations in other embodiments. The device can be attached to the batter's lower arm rather than the upper arm, provided it does not slide toward the wrist during a swing. The light source can be augmented or replaced by an energy source that emits energy other than light. Certain aspects of the disclosure described in the context of particular embodiments may be combined or eliminated in other embodiments. For example, in some embodiments, the elastic line 619 and attachment 620 described above can be eliminated. In other embodiments, certain aspects of any of the devices shown in FIGS. 1-5 can be combined with aspects of the devices shown in FIGS. 6-11 to provide an integrated motion control function. In still further embodiments, the system can include an arm-mounted device alone, or a tracking device that does not include an arm-mounted device specifically configured to control the user's load position. Further, while advantages associated with certain embodiments have been described in the context of those embodiments, other embodiments may also exhibit such advantages and not all embodiments need necessarily exhibit such advantages, to fall within the scope of the present disclosure. Accordingly, the disclosure can include other embodiments not expressly shown or described above.

I claim:

1. A system for controlling a user's baseball bat swing, comprising:

an arm-mounted device that includes:

an upper arm portion;

a lower arm portion pivotably connected to the upper arm portion;

at least one releasable attachment device carried by the upper arm portion or the lower arm portion and positioned to releasably attach to the user's arm; and an adjustment element operatively coupled to the upper arm portion and the lower arm portion, the adjustment element being manipulatable to control an angle between the upper arm portion and the lower arm portion;

a light source carried by the arm-mounted device, the light source having a light emission axis that is adjustable relative to the arm-mounted device; and a stowable pad positionable relative to the arm-mounted device to receive light from the light source, the stowable pad having:

a home plate indicator;

a foot location indicator that is movable relative to the home plate indicator;

a swing line indicator;

a load indicator that is movable along the swing line indicator; and a throw indicator that is movable along the swing line indicator.

2. The system of claim 1 wherein the stowable pad is rollable and unrollable along the swing line indicator.

3. The system of claim 1 wherein the stowable pad further includes:

an array of light detectors positioned to receive light from the light source, the light detectors having an off state and an on state, the on state being associated with light received from the light source, the light detectors having a signal transmitter to transmit an output signal corresponding to the state of the light detector;

an array of light indicators, with individual light indicators coupled to individual light detectors to receive a corresponding output signal, with individual light indicators being changeable in response to the corresponding output signal between a first state associated with the off state and a second state associated with the on state; and a reset device coupled to the light indicators to reset the light indicators to the first state.

4. The system of claim 3 wherein the light detectors include photoreceptors and wherein the light indicators include light emitting diodes.

5. The system of claim 1 wherein the swing line indicator includes a slot and wherein the load indicator and the throw indicator are slideable along the slot.

6. The system of claim 1 wherein the adjustment element includes a first adjustment element depending from the lower arm portion, a second adjustment element depending from the upper arm portion, and a locking member operatively coupled to the first and second adjustment elements to releasably secure the first and second adjustment elements at a plurality of positions relative to each other.

7. The system of claim 1 wherein the adjustment element includes a hinge having an internal frictional resistance sufficient to support the upper arm portion and the lower arm portion at a non-zero angle relative to each other.

8. A system for controlling a user's baseball bat swing, comprising:

an arm-mounted device that includes:

an upper arm portion;

a lower arm portion pivotably connected to the upper arm portion, with the upper arm portion or the lower arm portion positioned to releasably attach to the user's arm; and an adjustment element operatively coupled to the upper arm portion and the lower arm portion, the adjustment element being manipulatable to control an angle between the upper arm portion and the lower arm portion;

a light source carried by the arm-mounted device, the light source having a light emission axis that is adjustable relative to the arm-mounted device; and a stowable pad positionable relative to the arm-mounted device to receive light from the light source, the stowable pad having:

a home plate indicator;

a foot location indicator that is movable relative to the home plate indicator;

a swing line indicator;

a load indicator that is movable along the swing line indicator; and a throw indicator that is movable along the swing line indicator.

9. The system of claim 8 wherein the upper arm portion includes at least one releasable attachment device that further includes multiple straps positioned to encircle the user's upper arm.

10. The system of claim 8 wherein the upper arm portion and the lower arm portion each have a thickness extent and a lateral extent greater than the thickness extent, and wherein the upper arm portion and the lower arm portion are pivotable relative to each other about an axis that is generally parallel with the lateral extent of at least one of the upper and lower arm portions.

11. The system of claim 8 wherein the upper arm portion and the lower arm portion each have a thickness extent and a lateral extent greater than the thickness extent, and wherein the upper arm portion and the lower arm portion are pivotable relative to each other about an axis that is generally parallel with the thickness extent of at least one of the upper and lower arm portions.

12. The system of claim 8 wherein the adjustment element includes a first adjustment element depending from the lower arm portion, a second adjustment element depending from the upper arm portion, and a locking member operatively coupled to the first and second adjustment elements to releasably secure the first and second adjustment elements at a plurality of positions relative to each other.

13. The system of claim 8 wherein the adjustment element includes a hinge having an internal frictional resistance sufficient to support the upper arm portion and the lower arm portion at a non-zero angle relative to each other.

14. A method for controlling a batter's baseball bat swing, comprising:

releasably securing either 1) an upper arm portion of an arm-mounted device to an upper arm of the batter, or 2) a lower arm portion of the arm-mounted device to a lower arm of the batter;

adjusting an included angle between the upper arm portion and the lower arm portion to a fixed angle;

positioning the batter's arm in a load position with the lower arm contacting the lower arm portion and the upper arm contacting the upper arm portion;

during normal use, swinging the batter's arm from the load position to a throw position while disengaging the batter's arm from either 1) the upper arm portion, or 2) the lower arm portion; and repeating the positioning and swinging operations multiple times without adjusting the included angle between the upper arm portion and the lower arm portion.

15. The method of claim 14 wherein the arm-mounted device carries a light source having a light emission axis, and wherein the method further comprises:

positioning the batter on a pad having a home plate indicator and a swing line indicator;

adjusting a position of the batter's feet relative to the home plate indicator and the swing line indicator;

adjusting an orientation of the light emission axis;

adjusting a position of a load indicator along the swing line indicator to intersect the light emission axis with the load indicator when the batter's arm is in a load position; and adjusting a position of a throw indicator along the swing line indicator to intersect the light emission axis with the throw indicator when the batter's arm is in a throw position.

16. The method of claim 15, further comprising observing light emitted from the light source impinging on the pad, relative to the swing line indicator, as the batter executes a swing; and adjusting the batter's swing to align a path of the impinging light along the swing line indicator.

17. The method of claim 15, further comprising preserving an indication of a track of the impinging light on portion of the pad for a period of time after the light has ceased impinging on the portion of the pad.

18. The method of claim 14 wherein repeating the positioning and swinging operations multiple times includes repeating the positioning and swinging operations at least 20 times without adjusting the included angle between the upper arm portion and the lower arm portion.

19. The method of claim 14 wherein releasably securing includes releasably securing the upper arm portion of the arm-mounted device to the upper arm of the batter, and wherein the method further comprises not releasably securing the lower arm portion to the lower arm of the batter.

* * * * *